United States Patent [19]

Coburn

[11] 4,142,455

[45] Mar. 6, 1979

[54] SLITTING APPARATUS

[75] Inventor: Robert E. Coburn, Warminster, Pa.

[73] Assignee: Molins Machine Company, Inc., Cherry Hill, N.J.

[21] Appl. No.: 839,724

[22] Filed: Oct. 5, 1977

[51] Int. Cl.[2] ..... B31B 1/16

[52] U.S. Cl. ..... 93/58.2 R; 83/479; 83/499

[58] Field of Search ..... 83/479, 481, 499, 5, 83/11, 9; 93/58.2 R, 58.1

[56] References Cited

U.S. PATENT DOCUMENTS 2,393,586 1/1946 Bruker ..... 83/479

4,010,677 3/1977 Hirakawa et al. ..... 83/11

*Primary Examiner*—Donald R. Schran

*Attorney, Agent, or Firm*—Seidel, Gonda & Goldhammer

[57] ABSTRACT

Apparatus is disclosed for slitting a web of material such as paperboard utilizing at least two rotatable turrets disposed one above the other. Each turret has a pair of shafts adapted to have blades selectively positionable thereon by way of a master shifter which adjusts the blades for the next production run on one of the shafts which is in an inoperative position while the other shaft on each turret is in an operative position.

3 Claims, 4 Drawing Figures

SLITTING APPARATUS

BACKGROUND

Slitting apparatus particularly of the type known as an automatic slitter-scorer which includes either a computer or a mini-processor have been proposed heretofore. See U.S. Pat. Nos. 3,651,723; 3,961,547; 3,646,418; 3,831,502, 3,587,374; 4,010,677; 4,033,217. In the apparatus disclosed in said patents, blades are moved along a shaft to a predetermined position and then secured to the shaft for rotation therewith.

There is a need for a slitting apparatus such as a paper-board slitter-scorer which facilitates automatic adjustment of blades disposed in an inoperative position while other blades are in an operative position with respect to the moving web. There is a need for such apparatus which is structurally interrelated in a manner so that the device is short in the direction of movement of the web so that it may be readily substituted for existing equipment in the field. There is a need for such apparatus which facilitates passing the web through the apparatus without any slitting action.

SUMMARY OF THE INVENTION

The apparatus of the present includes a frame which rotatably supports at least two turrents disposed one above the other. The turrets are horizontally disposed. Each turret has a pair of parallel shafts. Each shaft has an operative position and an inoperative position.

A plurality of blades are provided on each shaft. A first motor is coupled such to each shaft for rotatably driving each shaft. A clutch associated with each shaft is provided for interrupting said driving connection when a shaft is in its inoperative position. A second motor means is coupled to each turret for simultaneously rotating each turret through an arc of 180° to thereby move a shaft from an operative position to an inoperative positive and vice versa.

A pair of master shifters are provided. Each shifter is supported for movement parallel to the axis of rotation of the turrets. Each shifter is adjacent the inoperative position of the shafts. Each shifter is provided with means for selectively moving one or more blades along their respective shafts while the shafts are in their inoperative position.

It is an object of the present invention to provide slitting apparatus which is simpler and less expensive than those provided heretofore while overcoming disadvantages of the prior art.

Other objects will appear hereinafter.

For the purpose of illustrating the invention, there is shown in the drawings a form which is presently preferred; it being understood, however, that this invention is not limited to the precise arrangements and instrumentalities shown. FIG. 1 is an end elevation view of apparatus in accordance with the present invention.

Figure 1:
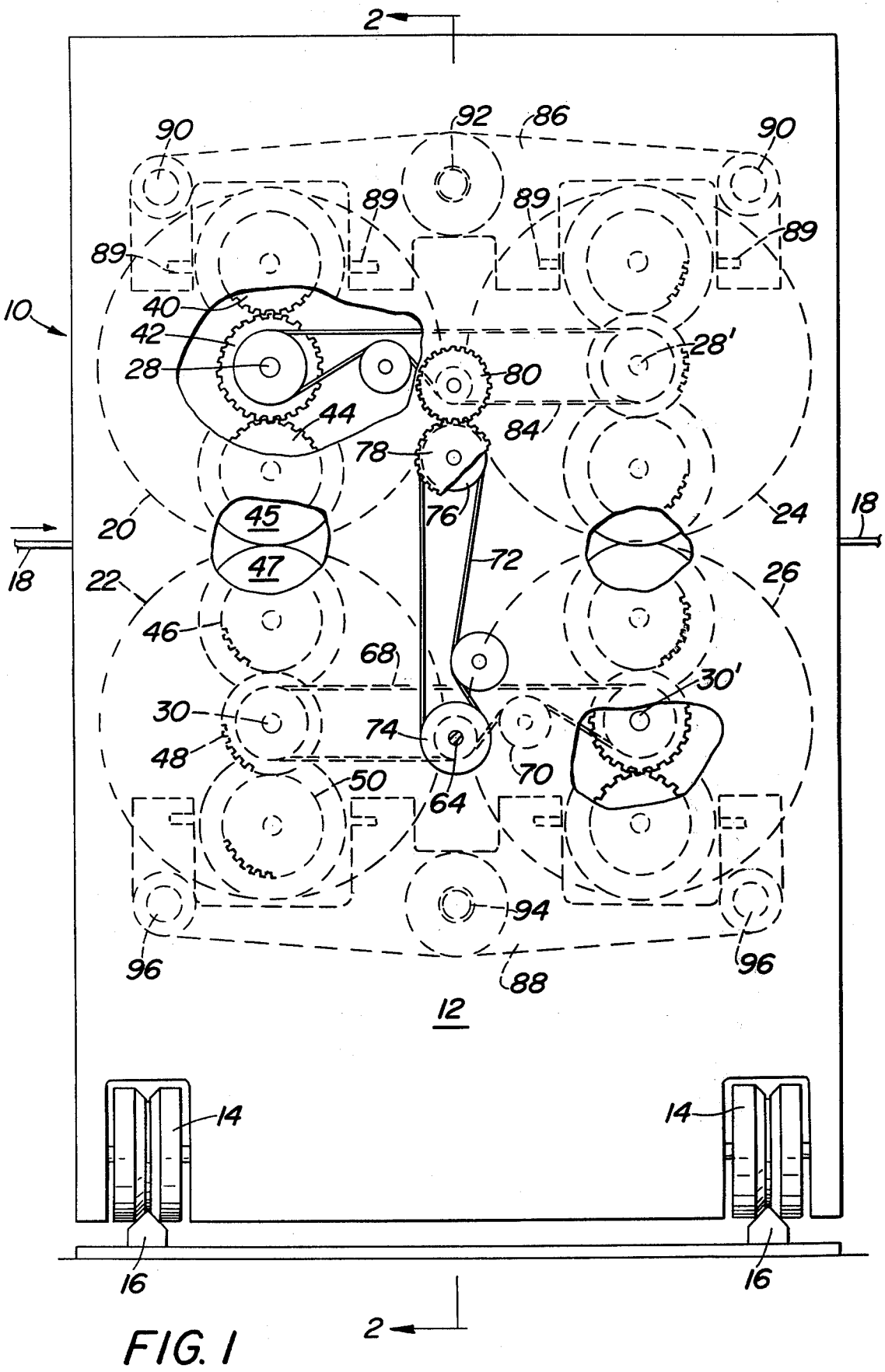

Referring to the drawings in detail, wherein like numerals indicate like elements, there is shown an end view of slitting apparatus in accordance with the present invention in FIG. 1. The apparatus 10 includes a housing defined by end frames 12 and 13 mounted on wheels 14. The wheels 14 ride on tracks 16 supported by a floor or the like. The wheels 14 and their associated tracks 16 facilitate adjusting the housing in a transverse direction with respect to the web 18. When the housing is properly adjusted with respect to the web 18, locking means not shown anchor the housing in a stationary position with respect to the web 18.

The slitting apparatus of the present invention for purposes of illustration takes the form of a slitter-scorer. When in the form of a slitter-scorer, the apparatus includes two sets of such turrets. The turrets of one set have blades adapted to slit the web and the other set has blades adapted to score the web. It is known to have rotatable turrets for slitting and scoring a web. For example, see U.S. Pat. No. 2,393,586.

Figure 2:
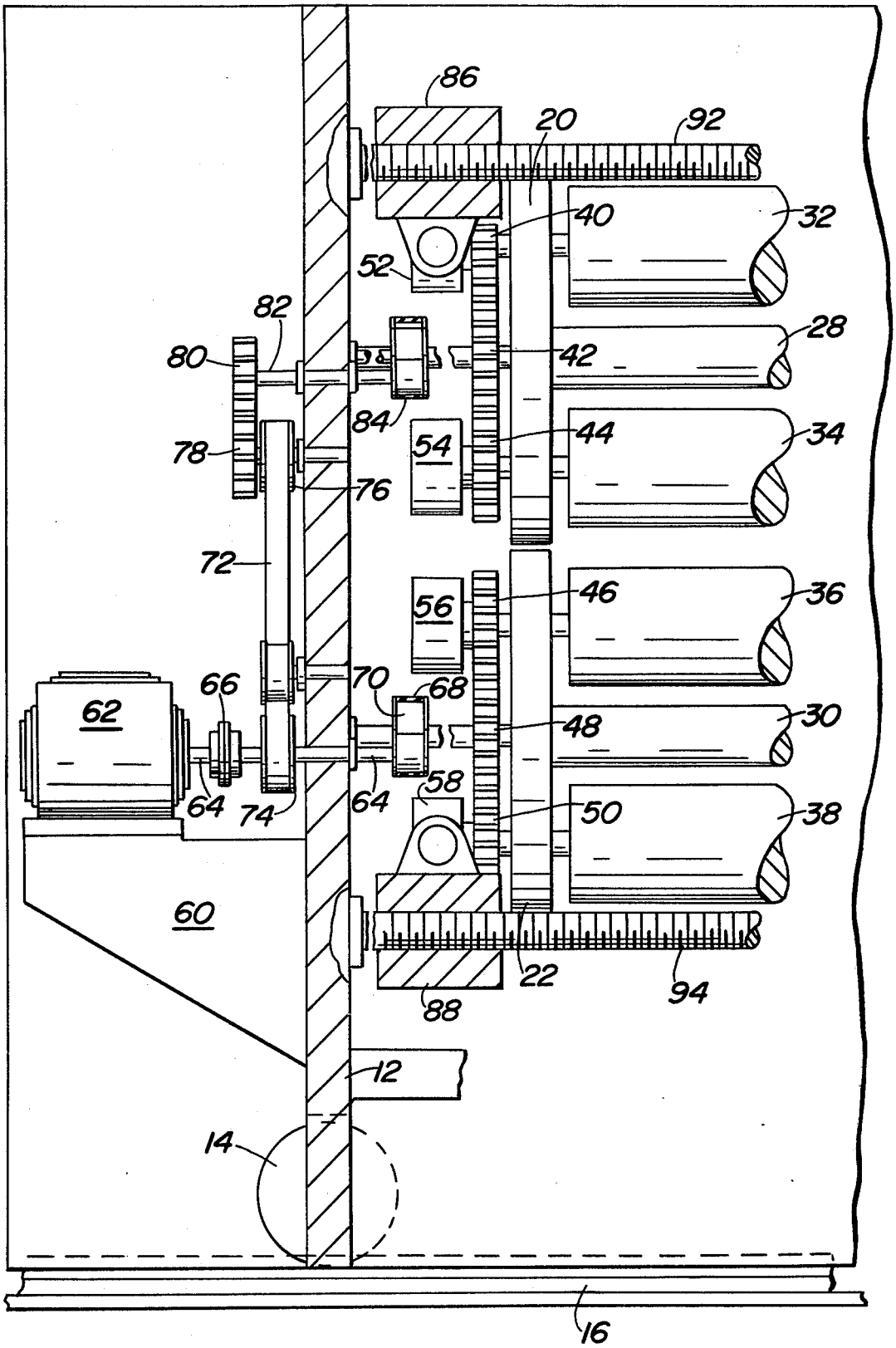
FIG. 2 is a sectional view taken along the line 2—2 in FIG. 1 showing one end of the apparatus.

Referring to FIGS. 1 and 2, turret 20 is rotatably supported above turret 22 while turret 24 is rotatably supported above turret 26. The turrets are supported for rotation about horizontal axes by the end frames 12, 13. The turrets 20 and 22 are disposed on opposite sides of a web 18 to be slit and cooperate with one another to slit the web 18 while the turrets 24 and 26 cooperate with one another to score the web 18. Since the sets of turrets cooperate with one another in the same manner, only turrets 20 and 22 will be described in detail. Where appropriate, corresponding primed numerals will be provided in connection with turrets 24, 26.

Turret 20 includes a pair of enlarged circular disks fixedly connected together by a shaft member 28 at the geometrical center of the disks. Turret 22 has a similar shaft member 30. Turret 20 includes a pair of diametrically disposed blade shafts 32, 34. Similar blade shafts 36 and 38 are provided on the turret 22. As will be apparent from FIG. 1, all of the blade shafts are disposed one above the other and parallel to one another.

A gear 40 on shaft 32 meshes with a gear 42 on shaft member 28 which in turn meshes with a gear 44 on shaft 34. A gear 46 on shaft 36 meshes with gear 48 on shaft member 30. Gear 48 meshes with gear 50 on shaft 38. All of the gears 40–50 are identical.

Gear 40 is operatively connected to shaft 32 by way of a clutch 52. Gear 44 is operatively connected to its shaft 34 by way of a clutch 54. Gear 46 is operatively connected to its shaft 36 by way of clutch 56. Gear 50 is operatively connected to its shaft 38 by way of clutch 58. No clutch is provided for the gears 42 and 48. The clutches 52–56 are operated in pairs and facilitates selective control of the rotation of the blade shafts 32, 34, 36 and 38. The clutches are electrically operated and per se are conventional.

Each of the shafts 32–38 has a plurality of slitting blades thereon. In the position shown in FIGS. 1 and 2, shafts 34 and 36 are in an operative position so that slitting blades 45 on shaft 34 may cooperate with a mating slitting blade 47 on the shaft 36. The shafts 32 and 38 are in an inoperative position and their respective clutches 52, 58 interrupt the driving connection between shafts 32, 38 and their respective gears 40, 50. Thus, gears 40 and 50 in the illustrated embodiment are free wheeling so long as their respective shafts are in their inoperative position.

Referring to FIG. 2, a bracket 60 is supported by the frame 12. A motor 62 is supported by bracket 60 and has an output shaft 64. For purposes of clarity, the motor and its bracket are not shown in FIG. 1. Shaft 64 is provided with a clutch 66.

A timing belt 68 extends around a sprocket on the shaft members 30, 30'. See FIG. 1. Belt 68 meshes with a sprocket on the drive shaft 64 and extends around an adjustable idler 70. Hence, the shafts on turrets 22 and 26 will be rotated in unison by the motor 62.

As shown in FIG. 2, the motor 62 and belt 68 are on opposite sides of the end frame 12. On the motor side of the end frame 12, shaft 64 is provided with a sprocket 74. A timing belt 72 extends around sprocket 74 and around a sprocket 76 supported by a stub shaft. A gear 78 is driven by said stub shaft. Gear 78 meshes with gear 80 on shaft 82. Shaft 82 supports a sprocket meshed with a timing belt 84. Timing belt 84 also extends around sprockets on the shaft members 28, 28'. Thus, the shafts on turrets 20 and 24 will be rotated in unison with each other and with the shafts on the turrets 22, 26.

A master shifter 86 is supported by the end frames 12, 13 for reciprocation by guide shafts 90 parallel to the turrets. A lead screw 92 is connected to the master shifter 86 to cause the same to move along the length of the shafts disposed in their inoperative position. The lead screw 92 is connected to an encoder which in turn is connected to a computer or microprocessor not shown.

The master shifter 86 has a pair of plungers selectively adapted to contact opposite sides of a blade on the inoperative shaft of each of the turrets 20, 24. The plungers are designated 89 and are of conventional construction involving a pneumatic cylinder with a plunger movable between extended and retracted positions. The plungers 89 are each selectively operable so that the master shifter 86 may move one or a plurality of blades on the inoperative shafts associated therewith. The plungers 89 may be of the type disclosed in U.S. Pat. Nos. 3,760,697; 4,010,677 or 4,033,217.

A second master shifter 88 is provided at an elevation below the elevation of turrets 22, 26. Master shifter 88 is identical with master shifter 86. Master shifter 88 is utilized to adjust the position of blades on the shafts of turrets 22, 26 when said shafts are in their inoperative position.

Figure 3:
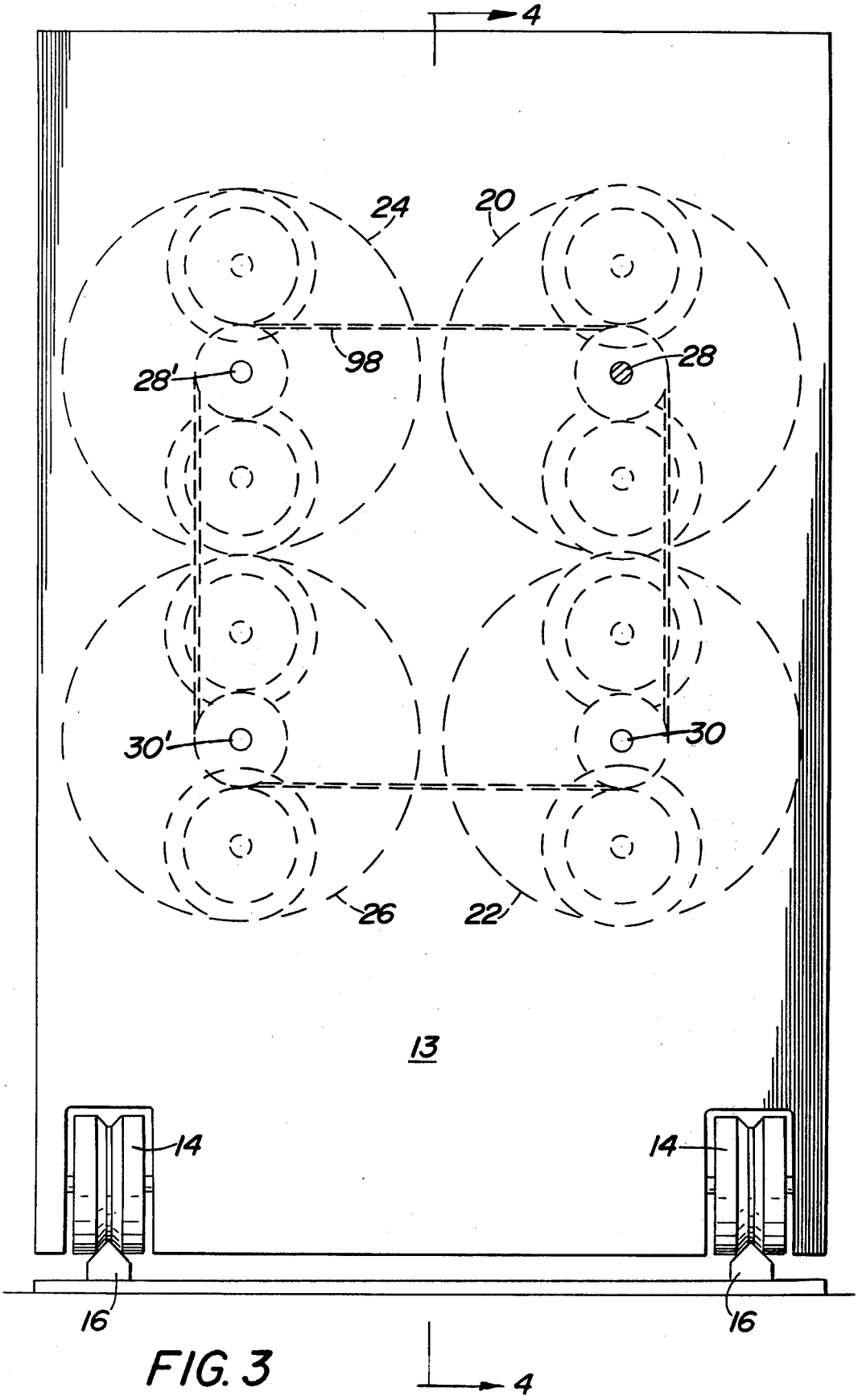
FIG. 3 is an end view as seen from the end opposite that shown in FIG. 1.
Figure 4:
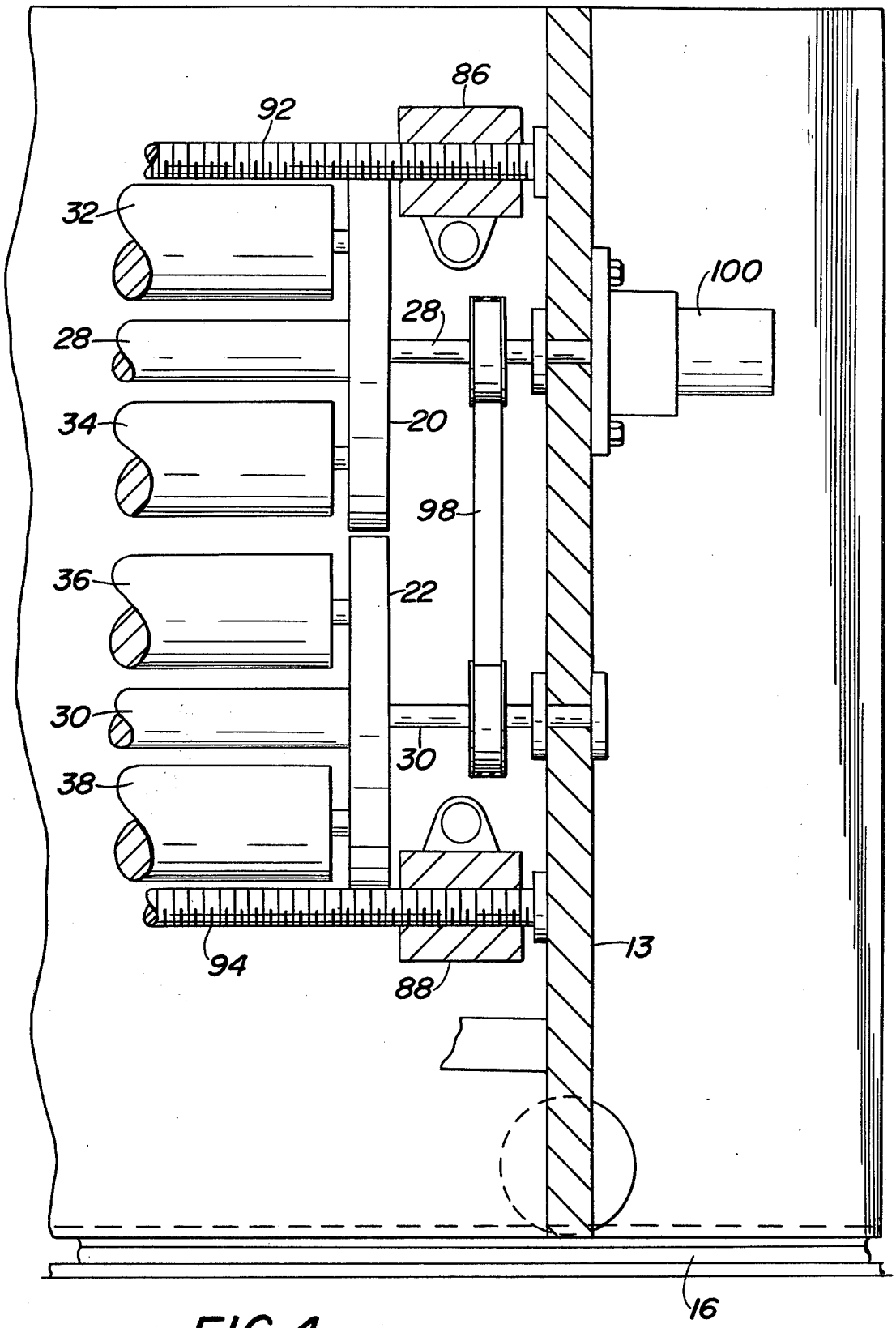
FIG. 4 is a sectional view taken along the line 4—4 in FIG. 3 and showing the end opposite to that shown in FIG. 2.

Referring to FIGS. 3 and 4, a means is provided for simultaneously rotating all of the turrets through an arc of 180° to thereby move the blade shafts between their operative and inoperative positions. At the end of the apparatus 10 remote from the motor 62, a discrete sprocket is provided on each of the shaft members 28, 28', 30, 30'. A timing belt 98 extends around said sprockets. A motor 100 is connected to one of the shaft members such as shaft member 28. Motor 100 is of conventional construction and is of the reversible type which when operated, rotates shaft member 28 through an arc of 180°. When motor 100 is operative, all of the turrets 20–26 simultaneously rotate through an arc of 180°. If desired, motor 80 may be adapted to interrupt such rotation after an arc of only 90° so that web 18 may move through the apparatus 10 without being contacted by any blades.

The apparatus 10 can be made with a length in the direction of movement of the web 18 of only 46 inches. Accordingly, the apparatus 10 is adapted to be substituted for slitter-scorer apparatus in the field even though such prior installed slitter-scorer apparatus is not of the automatic type. On the inlet side of the apparatus immediately to the left of the turrets 20, 22, guide vanes may be provided for guiding the web 18 to the nip between the blades 45, 47. A similar support plate may be provided between said nip and the nip of the cooperating blades on turrets 24, 26.

In view of the state of the art, in the above description, it is believed that the following general statement of operation is adequate. While the mating blades on the turrets 22–26 are slitting and/or scoring the web 18, the upper blade shafts on turrets 20, 24 are in an inoperative position and are declutched. Likewise, the lower blade shafts on the turrets 22, 26 are in an operative position and are declutched.

The master shifter 86 automatically moves one or a plurality of the blades on the inoperative shafts adjacent thereto to preposition such blades for the next production run. Also, the master shifter 88 simultaneously prepositions the blades on the inoperative shafts adjacent thereto to the desired position for the next production run. After a production run is completed, motor 100 simultaneously rotates each turret through an arc of 180°. Such rotation moves blade shafts from an inoperative position to an operative position and vice versa. The previously inoperative blades are rendered operative by their respective clutches such as clutch 52 and 58. Also, the clutches such as clutches 54 and 56 on the previously operative blade shafts are rendered inoperative. Thereafter, the master shifters 86, 88 are again utilized to preposition the blades on the inoperative shafts adjacent thereto for the next production run. The master shifters remain in the park position shown in FIG. 4 during the production run and whenever the turrets are being rotated.

The present invention may be embodied in other specific forms without departing from the spirit or essential attributes thereof and, accordingly, reference should be made to the appended claims, rather than to the foregoing specification as indicating the scope of the invention.

What is claimed is:

1. Apparatus for slitting and scoring a moving web comprising a frame, a first pair of turrets having an upper turret disposed above a lower turret, a second pair of turrets having an upper turret disposed above a lower turret, said upper turrets being at a first elevation, said lower turrets being at a second elevation, each of said turrets being supported by said frame for rotation about horizontal axes, each turret having a pair of diametrically disposed parallel blade shafts, each of said blade shafts including at least one axially movable blade for slitting or scoring the web, each of said blade shafts having an operative position and an inoperative position, a first motor means coupled to each of said blade shafts for rotatably driving each blade shaft, a clutch associated with each blade shaft for interrupting the driving connection between said first motor means and said blade shafts when a blade shaft is in an inoperative position, a second motor means coupled to each turret simultaneously rotating each turret through an arc of 180° to thereby move the blade shafts between their operative and inoperative positions, an upper shifter supported for movement parallel to the axes of said blade shafts adjacent the inoperative position of the blade shafts on the upper turrets, means associated with said upper shifter for selectively shifting blades on the blade shafts on the upper turrets while said shafts are in an inoperative position, a lower shifter supported for movement parallel to the axes of said blade shafts adjacent the inoperative position of the blade shafts on the lower turrets, means associated with said lower shifter for selectively shifting blades on the blade shafts on the lower turrets while said shafts are in an inoperative position, each of said shifters having a parked position between said frame and one end of the turrets, each turret being rotatable by said second motor means only when said shifters are in the parked position.

2. Apparatus in accordance with claim 1 including a first timing belt interconnecting the blade shafts on the upper turrets, a second timing belt interconnecting the blade shafts on the lower turrets, and drive means interconnecting said first and second timing belts with said first motor means.

3. Apparatus in accordance with claim 1 including a timing belt coupled to each of the turrets for causing the turrets to simultaneously rotate through said arc of 180° in response to actuation by said second motor means.

* * * * *